US010240546B2

(12) United States Patent
Burkhardt et al.

(10) Patent No.: US 10,240,546 B2
(45) Date of Patent: Mar. 26, 2019

(54) METHOD AND DEVICE FOR OPERATING AN INTERNAL COMBUSTION ENGINE

(71) Applicant: Continental Automotive GmbH, Hannover (DE)

(72) Inventors: Thomas Burkhardt, Neutraubling (DE); Juergen Dingl, Regensburg (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 87 days.

(21) Appl. No.: 15/312,241

(22) PCT Filed: Apr. 29, 2015

(86) PCT No.: PCT/EP2015/059300
§ 371 (c)(1),
(2) Date: Nov. 18, 2016

(87) PCT Pub. No.: WO2015/176930
PCT Pub. Date: Nov. 26, 2015

(65) Prior Publication Data

US 2017/0122240 A1 May 4, 2017

(30) Foreign Application Priority Data

May 22, 2014 (DE) ..... 10 2014 209 793

(51) Int. Cl.
*F02D 41/14* (2006.01)
*F02D 41/18* (2006.01)

(52) U.S. Cl.
CPC ..... *F02D 41/182* (2013.01); *F02D 41/1401* (2013.01); *F02D 2041/1416* (2013.01);
(Continued)

(58) Field of Classification Search
CPC ..... F02D 41/182; F02D 41/1401; F02D 2041/1433; F02D 2200/0402; F02D 2200/0406; F02D 2200/0414
(Continued)

(56) References Cited

U.S. PATENT DOCUMENTS 5,889,205 A 3/1999 Treinies et al. ..... 73/114.32
5,931,140 A * 8/1999 Maloney ..... F02D 41/0072 123/480

(Continued)

FOREIGN PATENT DOCUMENTS

CN 103775225 A 5/2014 ..... F02D 41/182
DE 112009002079 T5 7/2012 ..... F02D 41/00

(Continued)

OTHER PUBLICATIONS

"Handbuch Verbrennungsmotor, Grundlagen, Komponenten, Systeme, Perspekti ven" ["Internal combustion engine compendium, principles, components, systems, perspectives"], publisher Richard van Basshuysen/Fred Schafer, 2ndimproved edition, Friedrich Vieweg & Sohn Verlagsgesellschaft mbH, Braunschweig/Wiesbaden, pp. 557-559 (6 pages), Jun. 2.

(Continued)

*Primary Examiner* — Joseph J Dallo
*Assistant Examiner* — Yi-Kai Wang
(74) *Attorney, Agent, or Firm* — Slayden Grubert Beard PLLC

(57) ABSTRACT

The present disclosure relates to internal combustion engines in general. The teachings may be embodied in methods and devices for operating an internal combustion engine having one or more cylinders which are each assigned gas inlet valves. The method may include: in a first operating state, determining a model temperature of a gas in the intake tract cyclically for a present point in time using a (Continued)

predefined intake pipe model without reference to a present temperature measurement value of the gas; determining a cylinder air mass situated in a respective cylinder after closing the gas exchange valves based at least in part on the model temperature determined for the present point in time; and metering fuel into the respective cylinder based at least in part on the determined cylinder air mass. The model temperature for the present point in time depends at least in part on a model temperature determined for a preceding point in time.

8 Claims, 2 Drawing Sheets

(52) U.S. Cl.
CPC ..... *F02D 2041/1433* (2013.01); *F02D 2041/1437* (2013.01); *F02D 2200/0402* (2013.01); *F02D 2200/0406* (2013.01); *F02D 2200/0414* (2013.01)

(58) Field of Classification Search
USPC ..... 123/435
See application file for complete search history.

(56) References Cited

U.S. PATENT DOCUMENTS

| | | | | |
|---|---|---|---|---|
| 5,974,870 | A | 11/1999 | Treinies et al. | 73/114.33 |
| 6,272,427 | B1 * | 8/2001 | Wild | F02D 41/04 123/568.11 |
| 7,418,857 | B2 | 9/2008 | Tanaka | 73/114.34 |
| 8,473,182 | B2 | 6/2013 | Suzuki et al. | 701/103 |
| 9,228,519 | B2 | 1/2016 | Hagari | |
| 2007/0255483 | A1 * | 11/2007 | Tanaka | F02D 35/0023 701/101 |
| 2011/0172898 | A1 | 7/2011 | Eiraku et al. | 701/103 |
| 2015/0260112 | A1 * | 9/2015 | Liu | F02D 41/0002 123/350 |

FOREIGN PATENT DOCUMENTS

| | | | | |
|---|---|---|---|---|
| DE | 112010004825 | T5 | 9/2012 | F02D 11/10 |
| EP | 0886725 | B1 | 8/1999 | F02D 21/08 |
| EP | 0820559 | B1 | 9/1999 | F02D 41/04 |
| EP | 1443199 | A1 | 8/2004 | F02D 11/10 |
| EP | 1837512 | A1 | 9/2007 | F02B 37/00 |
| EP | 2527634 | A1 | 11/2012 | F02D 41/18 |
| JP | 01271642 | A | 10/1989 | F02D 41/00 |
| JP | 2006070881 | A | 3/2006 | F02D 41/18 |
| WO | 2009/092504 | A1 | 7/2009 | F02D 41/22 |
| WO | 2015/176930 | A1 | 11/2015 | F02D 41/18 |

OTHER PUBLICATIONS

Karlsson, Fredrik, "Modelling the Intake Manifold Dynamics in a Diesel Engine," LiTH-ISY-EX-3084, 87 pages, Apr. 2, 2001.
Lunze, J., "Regelungstechnik 2: Mehrgrössensysteme Digitale Regelung," Springer Publishing, 6 pages, Jan. 1, 2002.
Allgöwer, F., "Zustandrekonstruktion Mittels Beobachtern," Institut für Systemtheorie und Regelungstechnik, 5 pages, Feb. 19, 2002.
German Office Action, Application No. 102014209793.2, 4 pages, dated Oct. 31, 2014.
International Search Report and Written Opinion, Application No. PCT/EP2015/059300, 30 pages, dated Oct. 13, 2015.
Korean Office Action, Application No. 2017067178115, 7 pages, dated Sep. 24, 2017.
Chinese Office Action, Application No. 201580026475.0, 25 pages, dated Oct. 31, 2018.

* cited by examiner

METHOD AND DEVICE FOR OPERATING AN INTERNAL COMBUSTION ENGINE

CROSS-REFERENCE TO RELATED APPLICATIONS

This application is a U.S. National Stage Application of International Application No. PCT/EP2015/059300 filed Apr. 29, 2015, which designates the United States of America, and claims priority to DE Application No. 10 2014 209 793.2 filed May 22, 2014, the contents of which are hereby incorporated by reference in their entirety.

TECHNICAL FIELD

The present disclosure relates to internal combustion engines in general. The teachings may be embodied in methods and devices for operating an internal combustion engine having one or more cylinders which are each assigned gas inlet valves.

BACKGROUND

Ever more stringent restrictions on pollutant emissions of motor vehicles make it necessary to keep pollutant emissions as low as possible. One method to do so is by reducing the pollutant emissions that arise during the combustion of the air/fuel mixture in the respective cylinders of the internal combustion engine. A second method may include exhaust-gas aftertreatment systems which convert the pollutant emissions generated during the combustion process of the air/fuel mixture in the respective cylinders into non-hazardous substances. In one example, exhaust-gas catalytic converters convert carbon monoxide, hydrocarbons, and nitrogen oxides into non-hazardous substances. Both reduction of the pollutant emissions during the combustion in the respective cylinder and the conversion of the pollutant components with high efficiency by way of the exhaust-gas catalytic converter necessitate a very precisely set air/fuel ratio in the respective cylinder.

An intake pipe model is described for example in the specialist book "Handbuch Verbrennungsmotor, Grundlagen, Komponenten, Systeme, Perspektiven" ["Internal combustion engine compendium, principles, components, systems, perspectives"], publisher Richard van Basshuysen/Fred Schäfer, $2^{nd}$ improved edition, June 2002, Friedrich Vieweg & Sohn Verlagsgesellschaft mbH, Braunschweig/Wiesbaden, pages 557 to 559. Furthermore, intake pipe models of said type are also described in EP 0820559 B1 and EP 0886725 B1.

SUMMARY

The teachings of the present disclosure may be embodied in methods and devices for operating an internal combustion engine. These teachings may provide reliable operation of the internal combustion engine with low emissions.

Some embodiments may include methods for operating an internal combustion engine comprising an intake tract (1) and one or more cylinders (Z1 to Z4) which are each assigned gas inlet valves (12) and gas outlet valves (13), wherein gas exchange valves comprise gas inlet valves (12) and gas outlet valves (13). The methods may include, in a first operating state, a model temperature of a gas in the intake tract (1) is determined cyclically for a present point in time in a manner dependent on a predefined intake pipe model and independently of a temperature measurement value of the gas assigned to the present point in time. The model temperature for the present point in time is determined in a manner dependent on a model temperature that has been determined for a preceding point in time. Then, a cylinder air mass situated in the respective cylinder after a closure of the gas exchange valves is determined in a manner dependent on the model temperature determined for the present point in time.

In some embodiments, in a second operating state, a temperature measurement value of the gas is provided which is representative of a temperature of the gas at the present point in time. Then, a temperature corrective value is determined in a manner dependent on the model temperature for the present point in time and the provided temperature measurement value. A the temperature corrective value is assigned to the intake pipe model, and, at least in the first and in the second operating state, the model temperature for the present state is determined, in a manner dependent on the temperature corrective value, by way of the intake pipe model.

In some embodiments, in the second operating state, the temperature measurement value of the gas is provided which is representative of a temperature of the gas at the present point in time, and the model temperature for the present point in time is adapted in a manner dependent on the provided temperature measurement value.

In some embodiments, the model temperature for the present point in time is adapted in a manner dependent on the provided temperature measurement value by virtue of the model temperature being corrected in the direction of the temperature measurement value by a predefined factor.

In some embodiments, the model temperature for the present point in time is adapted in a manner dependent on the provided temperature measurement value by virtue of the model temperature being corrected in the direction of the temperature measurement value in a manner dependent on the magnitude of the difference of the model temperature and on the provided temperature measurement value.

In some embodiments, a model pressure of a gas in the intake tract (1) is determined cyclically for a present point in time in a manner dependent on the predefined intake pipe model and independently of a pressure measurement value of the gas assigned to the present point in time. The model pressure for the present point in time is determined in a manner dependent on a model pressure that has been determined for a preceding point in time. The cylinder air mass is determined in a manner dependent on the model pressure determined for the present point in time.

In some embodiments, in the second operating state, a pressure measurement value of the gas is provided which is representative of a pressure of the gas at the present point in time, a pressure corrective value is determined in a manner dependent on the model pressure for the present point in time and the provided pressure measurement value, the pressure corrective value is assigned to the intake pipe model, and, at least in the first and in the second operating state, the model pressure for the present state is determined, in a manner dependent on the pressure corrective value, by way of the intake pipe model.

In some embodiments, in the second operating state, the pressure measurement value of the gas is provided which is representative of a pressure of the gas at the present point in time, and the model pressure for the present point in time is adapted in a manner dependent on the provided pressure measurement value.

In some embodiments, the model pressure for the present point in time is adapted in a manner dependent on the provided pressure measurement value by virtue of the model pressure being corrected in the direction of the pressure measurement value by a predefined factor.

In some embodiments, the model pressure for the present point in time is adapted in a manner dependent on the provided pressure measurement value by virtue of the model pressure being corrected in the direction of the pressure measurement value in a manner dependent on the magnitude of the difference of the model pressure and on the provided pressure measurement value.

Some embodiments may include a device for operating an internal combustion engine comprising an intake tract (1) and one or more cylinders (Z1 to Z4) which are each assigned gas inlet valves (12) and gas outlet valves (13), wherein gas exchange valves comprise gas inlet valves (12) and gas outlet valves (13). The device may, in a first operating state, determine a model temperature of a gas in the intake tract (1) cyclically for a present point in time in a manner dependent on a predefined intake pipe model and independently of a temperature measurement value of the gas assigned to the present point in time. The model temperature for the present point in time is determined in a manner dependent on a model temperature that has been determined for a preceding point in time. The device may determine a cylinder air mass situated in the respective cylinder after a closure of the gas exchange valves in a manner dependent on the model temperature determined for the present point in time.

BRIEF DESCRIPTION OF THE DRAWINGS

Exemplary embodiments of the invention will be discussed in more detail below on the basis of the schematic drawings, in which.

Figure 1:
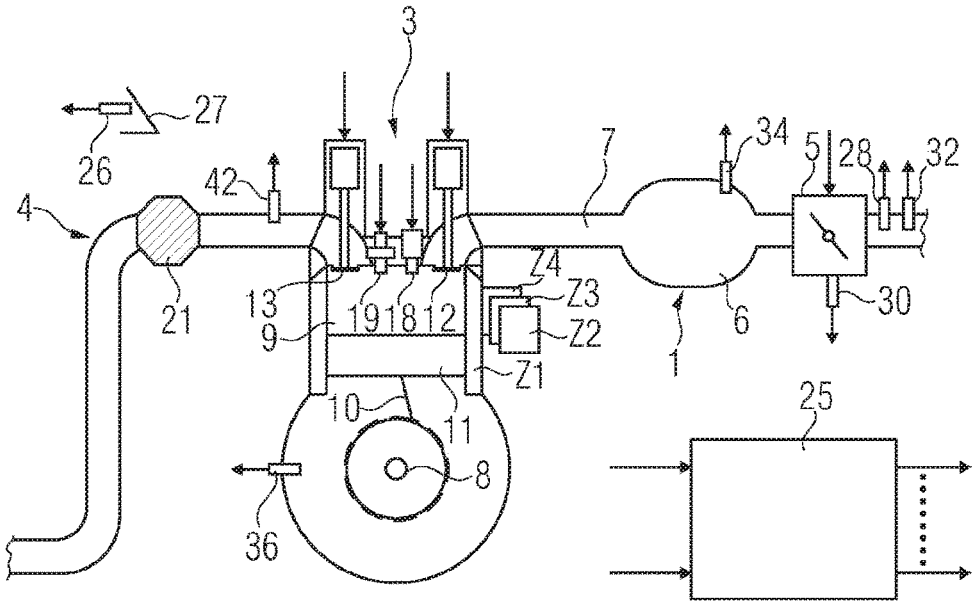
FIG. 1 shows an internal combustion engine with an associated control device.

Elements of identical construction or function are denoted by the same reference signs throughout the figures.

DETAILED DESCRIPTION

The methods and corresponding devices may be used for operating an internal combustion engine having an intake tract and one or more cylinders which are each assigned gas inlet valves and gas outlet valves, wherein gas exchange valves comprise gas inlet valves and gas outlet valves.

In a first operating state, a model temperature of a gas in the intake tract is determined cyclically for a present point in time in a manner dependent on a predefined intake pipe model and may be determined independently of a temperature measurement value of the gas assigned to the present point in time. The model temperature for the present point in time is determined in a manner dependent on a model temperature that has been determined for a preceding point in time. A cylinder air mass situated in the respective cylinder after a closure of the gas exchange valves is determined in a manner dependent on the model temperature determined for the present point in time. The first operating state may be a transient operating state. The preceding point in time is assigned to the preceding cycle.

A temperature sensor in the intake tract commonly exhibits a relatively long delay. If the cylinder air mass is determined independently of a temperature measurement value assigned to the present point in time, it is possible to determine a cylinder air mass very quickly, and for a contribution to be made to reliable operation of the internal combustion engine with low emissions, because the cylinder air mass can be utilized as a basis for the fuel metering.

In some embodiments, in a second operating state, a temperature measurement value of the gas is provided representative of a temperature of the gas at the present point in time. A temperature corrective value is determined in a manner dependent on the model temperature for the present point in time and the provided temperature measurement value. The temperature corrective value is assigned to the intake pipe model, and, at least in the first and in the second operating state, the model temperature for the present state is determined, in a manner dependent on the temperature corrective value, by way of the intake pipe model.

The second operating state may be a quasi-steady-state operating state. The quasi-steady-state operating state may be characterized by the fact that all input signals of the intake pipe model are substantially constant for a predefined time, for example several seconds. Since the temperature of the gas does not substantially change in the second operating state, the temperature measurement value of the gas which is representative of a temperature of the gas at the present point in time is for example the temperature measurement value of the gas assigned to the present point in time or a temperature measurement value of the gas assigned to the preceding point in time.

In some embodiments, the temperature corrective value is determined such that the difference between model temperature and temperature measurement value is minimized. For example, the model variable "temperature of the throttle flap mass flow" of the intake pipe model may be corrected by way of the temperature corrective value. It is also possible for an additional model input "heat flow through the intake pipe wall" to be introduced, which is not physically modelled and which is corrected by way of the temperature corrective value such that the difference between model temperature and temperature measurement value is minimized. In this way, the determination of the cylinder air mass is possible with particularly high accuracy.

In some embodiments, in the second operating state, the temperature measurement value of the gas is provided representative of a temperature of the gas at the present point in time, and the model temperature for the present point in time is adapted in a manner dependent on the provided temperature measurement value. In the second operating state, the relatively long delay of the temperature sensor may not limit the efficiency, because the values of the sensor substantially do not change. It is thus possible in the second operating state for the model temperature to be easily adapted to the temperature measurement value. Said adaptation may in turn be utilized upon a change to the first operating state, because in the first operating state, the model temperature for the present point in time is determined in a manner dependent on a model temperature that has been determined for a preceding point in time. In this way, it is thus possible for the cylinder air mass to be determined with particularly high accuracy and nevertheless very quickly in both operating states.

In some embodiments, the model temperature for the present point in time is adapted in a manner dependent on the provided temperature measurement value by virtue of the model temperature being corrected in the direction of the temperature measurement value by a predefined factor. In this way, the correction of the cylinder air mass is possible in a particularly robust and very simple manner, for example because very few calculation steps are required for the correction.

In some embodiments, the model temperature for the present point in time is adapted in a manner dependent on the provided temperature measurement value by virtue of the model temperature being corrected in the direction of the temperature measurement value in a manner dependent on the magnitude of the difference of the model temperature and on the provided temperature measurement value. In this way, the correction of the cylinder air mass is possible in a particularly robust and highly accurate manner, because the difference is utilized for the correction in a simple manner.

In some embodiments, a model pressure of a gas in the intake tract is determined cyclically for a present point in time in a manner dependent on the predefined intake pipe model and independently of a pressure measurement value of the gas assigned to the present point in time. The model pressure for the present point in time is determined in a manner dependent on a model pressure that has been determined for a preceding point in time. The cylinder air mass is determined in a manner dependent on the model pressure determined for the present point in time. A pressure sensor in the intake tract may also exhibit measurement errors. If the cylinder air mass is determined independently of a pressure measurement value which is assigned to the present point in time, it is possible for a cylinder air mass to be determined very quickly, and for a contribution to be made to reliable operation of the internal combustion engine with low emissions, because the cylinder air mass can be utilized as a basis for the fuel metering.

In some embodiments, in the second operating state, a pressure measurement value of the gas is provided which is representative of a pressure of the gas at the present point in time. A pressure corrective value is determined in a manner dependent on the model pressure for the present point in time and the provided pressure measurement value. The pressure corrective value is assigned to the intake pipe model, and, at least in the first and in the second operating state, the model pressure for the present state is determined, in a manner dependent on the pressure corrective value, by way of the intake pipe model.

The pressure corrective value may be determined by the difference between model pressure and pressure measurement value being minimized. For example, a model value of the intake pipe model which is representative of the effective cross-sectional area of the throttle flap is corrected by way of the pressure corrective value such that the difference between model pressure and pressure measurement value is minimized. In this way, the cylinder air mass can be determined with particularly high accuracy.

In some embodiments, in the second operating state, a pressure measurement value of the gas is provided which is representative of a pressure of the gas at the present point in time, and the model pressure for the present point in time is adapted in a manner dependent on the provided pressure measurement value. Since the pressure of the gas does not substantially change in the second operating state, the pressure measurement value of the gas which is representative of a pressure of the gas at the present point in time is for example the pressure measurement value of the gas assigned to the present point in time or a pressure measurement value of the gas assigned to the preceding point in time.

In the second operating state, the values of the pressure sensor do not change substantially. It is thus possible in the second operating state for the model pressure to be easily adapted to the pressure measurement value. Said adaptation may in turn be utilized upon a change to the first operating state, because in the first operating state, the model pressure is determined in a manner dependent on a model pressure that has been determined for a preceding point in time. In this way, it is thus possible for the cylinder air mass to be determined with particularly high accuracy and nevertheless very quickly in both operating states.

In some embodiments, the model pressure for the present point in time is adapted dependent on the provided pressure measurement value by virtue of the model pressure being corrected in the direction of the pressure measurement value by a predefined factor. In this way, the correction of the cylinder air mass is possible in a particularly robust and very simple manner, for example because very few calculation steps are required for the correction.

In some embodiments, the model pressure for the present point in time is adapted dependent on the provided pressure measurement value by virtue of the model pressure being corrected in the direction of the pressure measurement value in a manner dependent on the magnitude of the difference of the model pressure and on the provided pressure measurement value. In this way, the correction of the cylinder air mass is possible in a particularly robust and highly accurate manner, because the difference is utilized for the correction in a simple manner.

In some embodiments, an internal combustion engine comprises an intake tract 1, an engine block 2, a cylinder head 3 and an exhaust tract 4. The intake tract 1 may include a throttle flap 5, a manifold 6, and an intake pipe 7 which leads to a cylinder Z1 via an inlet duct into a combustion chamber 9 of the engine block 2. The engine block 2 comprises a crankshaft 8 which is coupled by way of a connecting rod 10 to a piston 11 of the cylinder Z1. The internal combustion engine may include further cylinders Z2, Z3, Z4 in addition to the cylinder Z1. The internal combustion engine may however also comprise any other desired number of cylinders. The internal combustion engine may be arranged in a motor vehicle.

Cylinder head 3 may comprise an injection valve 18 and an ignition plug 19. Alternatively, the injection valve 18 may also be arranged in the intake pipe 7. In the exhaust tract 4 there may be an exhaust-gas catalytic converter 21 in the form of a three-way catalytic converter.

Furthermore, the engine may comprise a phase adjustment means which is coupled to the crankshaft 8 and to an inlet camshaft. The inlet camshaft is coupled to a gas inlet valve 12 of the respective cylinder. The phase adjustment means may permit an adjustment of a phase of the inlet camshaft relative to the crankshaft 8. Furthermore, the phase adjustment means may adjust a phase of an outlet camshaft relative to the crankshaft 8, wherein the outlet camshaft is coupled to a gas outlet valve 13.

Furthermore, the engine may comprise a switching flap or some other switching mechanism for varying an effective intake pipe length in the intake tract 1. Furthermore, some embodiments may include one or more swirl flaps and/or a supercharger, which may be in the form of an exhaust-gas turbocharger and thus comprise a turbine and a compressor.

Some embodiments may include a control device 25 with assigned sensors detecting various measurement variables and, in each case, the measurement value of the measurement variable. Operating variables of the internal combustion engine may include the measurement variables and variables derived from the measurement variables. The control device 25 may determine, in a manner dependent on at least one measurement variable, control variables which are then converted into one or more control signals for the control of the control elements by way of corresponding control drives. The control device 25 may also be referred to as a device for operating the internal combustion engine.

The sensors may include a pedal position transducer 26, which detects an accelerator pedal position of an accelerator pedal 27, an air mass sensor 28, which detects an air mass flow upstream of the throttle flap 5, a throttle flap position sensor 30, which detects a degree of opening of the throttle flap 5, an ambient pressure sensor 32, which detects an ambient pressure in the surroundings of the internal combustion engine, an intake pipe pressure sensor 34, which detects an intake pipe pressure in the manifold 6, a crankshaft angle sensor 36, which detects a crankshaft angle, to which a speed of the internal combustion engine is then assigned.

Furthermore, the engine may comprise an exhaust-gas probe 42 arranged upstream of the exhaust-gas catalytic converter 21 and which detects, for example, a residual oxygen content of the exhaust gas of the internal combustion engine, and the measurement signal of which is representative of an air/fuel ratio upstream of the exhaust-gas probe 42 before the combustion. For the detection of the position of the inlet camshaft and/or of the outlet camshaft, the sensors may include an inlet camshaft sensor and/or an outlet camshaft sensor.

Furthermore, some embodiments may include a temperature sensor which detects an ambient temperature of the internal combustion engine, and/or for a further temperature sensor, the measurement signal of which is representative of an intake air temperature in the intake tract 1, which can also be referred to as intake pipe temperature. Furthermore, some embodiments may include an exhaust-gas pressure sensor, the measurement signal of which is representative of an exhaust manifold pressure, that is to say a pressure in the exhaust tract 4. Depending on the embodiment, any desired subset of the stated sensors may be provided, or additional sensors may also be provided.

The control elements may include, for example, the throttle flap 5, the gas inlet and gas outlet valves 12, 13, the injection valve 18, the phase adjustment means, the ignition plug 19, and/or an exhaust-gas recirculation valve.

The air-fuel ratio, the ratio of the air mass $m_{air,cyl}$ participating in the combustion in the cylinder, which can also be referred to as cylinder air mass, to the fuel mass $m_{fuel}$ participating in the combustion in the cylinder is an important influential factor for the pollutant emissions of an internal combustion engine. The cylinder air mass $m_{air,cyl}$ is estimated in the control device (engine control unit) on the basis of numerous available variables and serves as a basis for the fuel metering. For compliance with present and future pollutant emission limit values, the cylinder air mass must be known accurately, to within a few percent, in the engine control unit under all steady-state and transient engine operating conditions.

The pressure and temperature of the gas situated in the intake tract 1 (intake pipe pressure $p_{im}$ and intake pipe temperature $T_{im}$) are major influential factors on the cylinder air mass $m_{air,cyl}$ drawn in by the engine, and must be known with the greatest possible accuracy for correct estimation of the cylinder air mass in the engine control unit.

The intake pipe pressure $p_{im}$ may also be referred to as model pressure of a gas in the intake tract 1. The intake pipe temperature $T_{im}$ may also be referred to as model temperature of a gas in the intake tract 1.

Modern internal combustion engines are usually equipped with a further temperature sensor for the measurement of the gas temperature in the intake tract 1, which can also be referred to as intake pipe temperature sensor. Typical intake pipe temperature sensors for series usage exhibit a strong PT1 characteristic with time constants in the region of 5 seconds. Additionally, modern internal combustion engines are almost always equipped with the intake pipe pressure sensor 34 and/or air mass sensor 28 with negligible time constants (a few milliseconds).

In embodiments of the present disclosure, it is either possible for the measured intake pipe pressure $p_{im,mes}$ to be used directly as a model input for the determination of the cylinder air mass, or to be modelled by means of a state observer (generally referred to as intake pipe model) and for intake pipe pressure $p_{im,mdl}$ aligned with the measured intake pipe pressure $p_{im,mes}$ or measured air mass flow $\dot{m}_{air,mes}$ to be used as model input for the determination of the cylinder air mass. Furthermore, the intake pipe temperature can be used as model input for the determination of the cylinder air mass. Here, use is made either of the measured intake pipe temperature $T_{im,mes}$ directly or of a corrected intake pipe temperature $T_{im,mdl}$, for which the measurement value is expanded by corrections for describing steady-state warm-up effects between temperature sensor and inlet valve. Although all measured/observed changes of the intake pipe pressure are incorporated quickly—that is to say with a delay of a few milliseconds—into the modelling of the cylinder air mass, changes of the intake pipe temperature are however incorporated only slowly with the dynamics predefined by the sensor, with a time constant of several seconds.

Fluctuating actuator positions of the internal combustion engine, of the intake pipe pressure $p_{im}$, and of the intake pipe temperature $T_{im}$, that is to say without the delay resulting from the long time constants of the temperature sensor. In particular, an intake pipe temperature modelled in this way is available more quickly than a measurement value detected by way of temperature sensors available for series-production internal combustion engines. In this way, the modelling of the cylinder air mass $m_{air,cyl}$ is improved, and thus a contribution is made to the reduction of the pollutant emissions of internal combustion engines.

System Limits and Prerequisites

The system being considered comprises the intake tract 1 of an internal combustion engine with the gas situated therein. Said system is delimited by the intake pipe wall, the gas inlet valves 13 of the cylinders Z1 to Z4 of the internal combustion engine, the throttle flap 5 and the inlets of any further gas mass flows, such as for example for tank ventilation, crankcase ventilation or fuel injection. The modelling follows a OD consideration; no distinction is made between positions in the intake tract 1.

Figure 2:
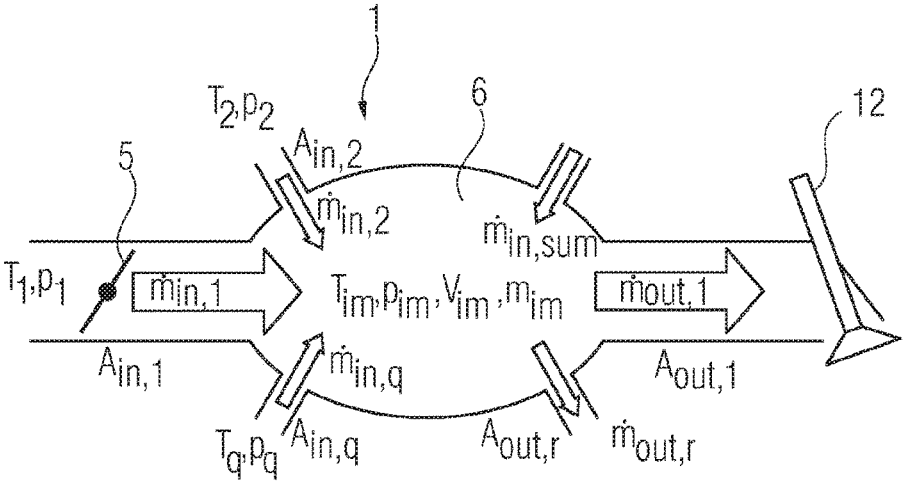
FIG. 2 shows a detail of an intake tract of the internal combustion engine.

In the intake tract 1 with the constant volume $v_{im}$, there is situated a gas mass $m_{im}$ with the present intake pipe pressure $p_{im}$ and the present intake pipe temperature $T_{im}$ (FIG. 2). The general gas equation applies:

$$p_{im}\cdot V_{im}=m_{im}\cdot R\cdot T_{im} \qquad ((1)).$$

Mass Flows Taken into Consideration

In the general case, there are multiple mass inflows $\dot{m}_{in,1}$, $\dot{m}_{in,2}$, . . . $\dot{m}_{in,q}$, which are influenced by the intake pipe pressure, from q sources with known gas states (that is to say source pressures $p_{0,1}$, $p_{0,2}$, . . . $p_{0,q}$ and source temperatures $T_{0,1}$, $T_{0,2}$, . . . $T_{0,q}$). Said q mass inflows flow via q throttle points with the effective cross-sectional areas $A_{in,1}$, $A_{in,2}$, . . . $A_{in,q}$ into the intake tract 1:

$$\dot{m}_{in,i}=A_{in,i}\cdot p_{0,i}\cdot C(T_{0,i})\cdot\Psi(\Pi_i);\ i\in[1\ldots q] \qquad ((2)).$$

where: $\dot{m}_{in,1}$—mass flow, $T_{0,1}$—temperature upstream of throttle point, $p_{0,1}$—pressure upstream of throttle point of the gas flowing in via the i-th throttle point, $$C(T_{0,i}) = \sqrt{\frac{2\cdot\kappa}{(\kappa-1)\cdot R\cdot T_{0,i}}} \quad ((3))$$

temperature factor with κ—isentropic exponent, $R=c_p-c_v$—specific gas constant, $c_p$—specific heat capacity at constant pressure, $c_v$—specific heat capacity at constant volume of the inflowing gas, $$\Pi_i = \frac{p_{im}}{p_{0,i}} \quad ((4))$$

pressure ratio at the i-th throttle point, $$\Psi(\Pi_i) = \begin{cases} \left(\frac{2}{\kappa+1}\right)^{\frac{1}{\kappa-1}}\sqrt{\frac{\kappa-1}{\kappa+1}} & \text{for } \Pi_i < 0.53, \text{ i.e. supercritical pressure ratio} \\ \sqrt{\left(\frac{p_{im}}{p_{0,i}}\right)^{\frac{2}{\kappa}} - \left(\frac{p_{im}}{p_{0,i}}\right)^{\frac{\kappa+1}{\kappa}}} & \text{for } \Pi_i \geq 0.53, \text{ i.e. subcritical pressure ratio} \end{cases} \quad ((5))$$

Throughflow coefficient at the i-th throttle point, can be linearized for the operating point $\Pi_i$ to $$\Psi(\Pi_i)=\Psi_{offset}(\Pi_i)-\Psi_{slope}(\Pi_i)\cdot\Pi_i \quad ((6))$$

For simplification, for all of the gases flowing in the intake tract 1, uniform values are assumed in each case for isentropic exponent, gas constant and heat capacities.

Said mass inflows are influenced by the intake pipe pressure

- because the pressure ratio $\Pi_i$ across the respective throttle point may at least in some operating states be subcritical, that is to say with $\Pi_i \geq 0.53$,
- because the throughflow coefficient $\Psi(\Pi_i)$ is then, in accordance with equation ((5)), dependent on the intake pipe pressure $p_{im}$, and
- because said mass flows are intended to be incorporated as a function of the intake pipe pressure—not merely as a value—into the intake pipe model.

Examples for inflows into the intake tract 1 that are influenced by the intake pipe pressure are the mass flow of an external exhaust-gas recirculation arrangement, the crankcase ventilation mass flow, the tank ventilation mass flow and the throttle flap mass flow, which is dominant in practically all operating states. Said inflows linearize in accordance with the intake pipe pressure $p_{im}$, and can be represented as linear functions of the intake pipe pressure in the form of $\dot{m}_{in,i}=L_{in,i}*p_{im}+K_{in,i}$, where $i\in\lfloor 1 \ldots q\rfloor$.

In the general case, there are multiple mass outflows, influenced by the intake pipe pressure $p_{im}$, into s different sinks. Examples of outflows from the intake tract 1 are leakage mass flows during supercharged operation and the inlet valve mass flow, which is dominant in practically all operating states. In practical terms, there is, in the case of the internal combustion engine operating faultlessly, only one mass flow out of the intake tract 1, that is the inlet valve mass flow into the cylinders respectively in the intake stroke. This will hereinafter be referred to as outflow mass flow $\dot{m}_{out}$. This is, at the respective engine operating point, linearized in accordance with the intake pipe pressure $p_{im}$, and approximated as a linear function of the intake pipe pressure $p_{im}$ with the parameters $\eta_{slope}$, $\eta_{offset}$ (gradient and offset of the volumetric efficiency):

$$\dot{m}_{out}=\eta_{slope}\cdot p_{im}\cdot\eta_{offset} \quad ((7)).$$

The negative sign of the offset is not imperative.

In the general case, there are further mass inflows $\dot{m}_{in,q+1}$, $\dot{m}_{in,q+2}, \ldots \dot{m}_{in,q+r}$, which are not influenced by the intake pipe pressure $p_{im}$ from r sources with known gas states (that is to say source pressures $p_{0,q+1}, p_{0,q+2}, \ldots p_{0,q+r}$ and source temperatures $T_{0,q+1}, T_{0,q+2}, \ldots T_{0,q+r}$). The equations ((2)) to ((6)) apply correspondingly for these. Said mass inflows are not influenced by the intake pipe pressure $p_{im}$

- because either the pressure ratio across the respective throttle point is supercritical in all operating states, that is to say $\Pi_i<0.53$, the throughflow coefficient Ψ is then constant in accordance with equation ((5)), and the respective value of the inflow mass flow can be calculated independently of the intake pipe pressure $p_{im}$ (e.g. at the gas injection valve for CNG), or
- because, despite a possibly subcritical pressure ratio $\Pi_i \geq 0.53$ at a throttle point, as a model simplification, the associated mass flow is calculated on the basis of an old value of the intake pipe pressure $p_{im,n-1}$ outside the intake pipe model and is then incorporated merely as a value (not as a function of the intake pipe pressure) into the intake pipe model.

In the intake tract 1, the law of conservation of mass (mass balancing) applies generally for s outflows and specifically for one outflow. Below, without restricting the general nature, only one outflow will be considered:

$$\dot{m}_{im} = \sum_{i=1}^{q+r}\dot{m}_{in,i} - \sum_{j=1}^{s}\dot{m}_{out,j} = \sum_{i=1}^{q+r}\dot{m}_{in,i} - \dot{m}_{out}. \quad ((8))$$

Modelling

The enthalpy $H_{im}$ of the gas in the intake tract 1 with constant volume $V_{im}$ is equal to the sum of displacement work $V_{im}\cdot p_{im}$, heat energy $W_{therm}$, potential energy $W_{pot}$ and kinetic energy $W_{kin}$ of the gas in the intake tract 1:

$$H_{im}=W_{therm}+W_{pot}+W_{kin}+p_{im}\cdot V_{im} \quad (9)).$$

The potential energy of the gas in the intake tract 1 $W_{pot}$ can be disregarded because no significant height difference exists between the intake tract inlet and outlet and the potential energy of gases is generally negligible owing to their relatively low density. The kinetic energy of the gas in the intake pipe $W_{kin}$ is, in the pressure and temperature range relevant for the operation of internal combustion engines, less than the respective displacement work and heat energy of the gas by at least a factor of 100, and can thus also be disregarded. Thus, the enthalpy of the gas in the intake tract 1 is calculated as $$\begin{aligned} H_{im} &= W_{therm} + p_{im}\cdot V_{im} \\ &= c_v\cdot T_{im}\cdot m_{im} + p_{im}\cdot V_{im}, \end{aligned} \quad ((10))$$

where: $T_{im}$—temperature, $m_{im}$—mass of the gas in the intake tract 1.

For the intake tract 1 as an open system with q+r inflows and one outflow, disregarding heat transfer through the intake pipe wall (which will be discussed again further below), the enthalpy balance is as follows:

$$\frac{d}{dt}H_{im} = \sum_{i=1}^{q+r}\left(\dot{m}_{in,i}\cdot\left(h_{in,i} + \frac{1}{2}\cdot v_{in,i}^2 + g\cdot z_{in,i}\right)\right) - \dot{m}_{out}\cdot\left(h_{out} + \frac{1}{2}\cdot v_{out}^2 + g\cdot z_{out}\right), \quad ((11))$$

where: $h_{in,i}$—specific enthalpy, $v_{in,i}$—flow speed, $z_{in,i}$—height of the i-th mass inflow, $h_{out}$—specific enthalpy, $v_{out}$—flow speed, $z_{out}$—height of the mass outflow, g—gravitational acceleration.

As a result of the above-described disregarding of kinetic and potential energy of the gas in the intake tract 1, flows speeds and heights are disregarded, and equation ((11)) is simplified to $$\frac{d}{dt}H_{im} = \sum_{i=1}^{q+r}(\dot{m}_{in,i}\cdot h_{in,i}) - \dot{m}_{out}\cdot h_{out}. \quad ((12))$$

The outflowing masses have intake pipe temperature $T_{im}$, and thus the specific enthalpy of the outflow mass flow is $$h_{out}=c_p\cdot T_{im} \quad ((13)).$$

The inflowing masses have in each case the temperature of their source $T_{0,i}$, and thus the specific enthalpy of the i-th inflow mass flow is $$h_{in,i}=c_p\cdot T_{0,i} \quad ((14)).$$

Inserting equations ((10)), ((13)) and ((14)) into equation ((12)) yields $$c_v\cdot\dot{m}_{im}\cdot T_{im} + c_v\cdot m_{im}\cdot\dot{T}_{im} + \dot{p}_{im}\cdot V_{im} + p_{im}\cdot\dot{V}_{im} = c_p\cdot\sum_{i=1}^{q+r}(\dot{m}_{in,i}\cdot T_{0,i}) - \dot{m}_{out}\cdot c_p\cdot T_{im}. \quad ((15))$$

Owing to the constant intake pipe volume, $p_{im}\cdot\dot{V}_{im}=0$. Taking into consideration the functional dependencies from ((1)), ((2)), ((4)) and ((8)), one obtains from ((15)), by rearrangement, $$\dot{p}_{im}\cdot V_{im} = c_p\cdot\left(\sum_{i=1}^{q+r}(\dot{m}_{in,i}(p_{im})\cdot T_{0,i}) - \dot{m}_{out}(p_{im})\cdot T_{im}\right) - c_v\cdot\left(\dot{m}_{im}(p_{im})\cdot T_{im} + m_{im}(p_{im}, T_{im})\cdot\dot{T}_{im}\right) \quad ((16))$$

a first implicit first-order differential equation of the variable intake pipe pressure $p_{im}$ and intake pipe temperature $T_{im}$.

The derivative with respect to time of the general gas equation for the gas in the intake tract 1 ((1)) yields $$\dot{p}_{im}\cdot V_{im}+p_{im}\cdot\dot{V}_{im}=\dot{m}_{im}\cdot R\cdot T_{im}+m_{im}\cdot R\cdot\dot{T}_{im} \quad ((17)).$$

Owing to the constant intake pipe volume, $p_{im}\cdot\dot{V}_{im}=0$. Taking into consideration the functional dependencies from ((1)), ((2)), ((4)) and ((8)), one obtains from ((17))

$$\dot{p}_{im}\cdot V_{im}=m_{im}(p_{im})\cdot R\cdot T_{im}+m_{im}(p_{im}, T_{im})\cdot R\cdot\dot{T}_{im} \quad ((18))$$

a second implicit first-order differential equation of the variable intake pipe pressure $p_{im}$ and intake pipe temperature $T_{im}$.

Discretization of the Model

The two first-order differential equations of the variables intake pipe pressure $p_{im}$ and intake pipe temperature $T_{im}$ ((16)) and ((18)) are rearranged such that, on the one hand, the intake pipe pressure gradient $\dot{p}_{im}$ and, on the other hand, the intake pipe temperature gradient $\dot{T}_{im}$ are eliminated.

The difference of the equations ((18))-((16)) eliminates the intake pipe pressure gradient $\dot{p}_{im}$. After inserting the mass balance ((8)), rearranging for $\dot{T}_{im}$ yields $$\dot{T}_{im} = \frac{1}{m_{im}(p_{im}, T_{im})}\cdot\sum_{i=1}^{q+r}(\dot{m}_{in,i}(p_{im})\cdot(T_{0,i} - T_{im})). \quad ((19))$$

Figure 3:
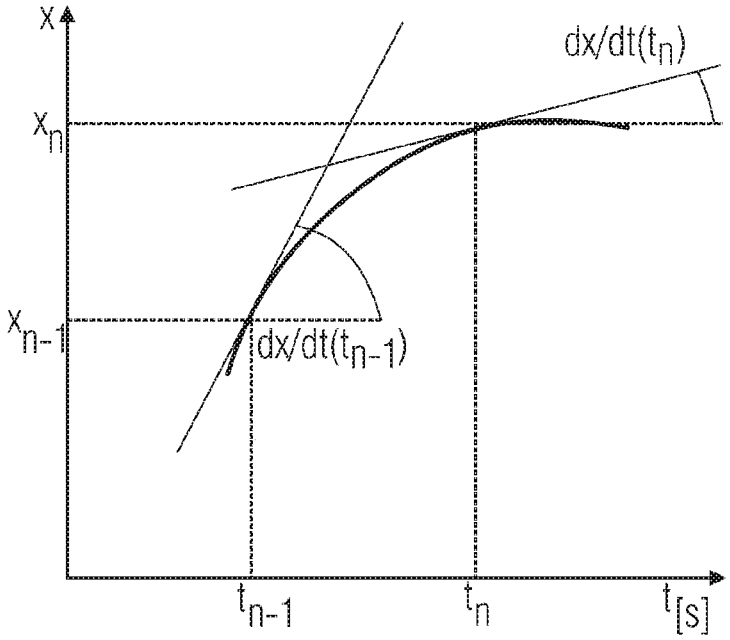
FIG. 3 shows a trapezoidal integration formula applied to a function x(t).

The generally applicable trapezoidal integration formula (see FIG. 3) is applied to the intake pipe temperature $T_{im}$ for the discretization with respect to time of the model $$x_n = x(t_n) = x(t_{n-1}) + \frac{\dot{x}(t_{n-1}) + \dot{x}(t_n)}{2}\cdot(t_n - t_{n-1}), \quad ((20))$$

with the sampling time $t_s=t_n-t_{n-1}$:

$$T_{im} = T_{im,n} = T_{im,n-1} + \frac{t_s}{2}\cdot(\dot{T}_{im,n-1} + \dot{T}_{im}). \quad ((21))$$

Old intake pipe temperature $T_{im,n-1}$ and old intake pipe temperature gradient $\dot{T}_{im,n-1}$ are values that are known at the point in time n from the preceding calculation step n−1. By inserting equation ((19)) into ((21)), the intake pipe temperature gradient $\dot{T}_{im}$ is also eliminated:

$$T_{im} = T_{im,n-1} + \frac{t_s}{2}\cdot\dot{T}_{im,n-1} + \frac{t_s}{2\cdot m_{im}(p_{im}, T_{im})}\cdot\sum_{i=1}^{q+r}(\dot{m}_{in,i}(p_{im})\cdot(T_{0,i} - T_{im})). \quad ((22))$$

The terms with values known at the start of the calculations for point in time n are combined in order to simplify the further derivation:

$$G_{0,1} = T_{im,n-1} + \frac{t_s}{2}\cdot\dot{T}_{im,n-1}. \quad ((23))$$

A replacement of the present gas mass in the intake tract 1 in equation ((22)) in accordance with equation ((1))

$$m_{im} = \frac{p_{im}\cdot V_{im}}{R\cdot T_{im}} \quad ((24))$$

would complicate the linear equation ((22)) in $T_{im}$ with a quadratic term $T_{im}^2$. Since the gas mass in the intake tract 1 cannot abruptly change and changes only relatively little in a calculation step, it is possible, without great loss of accuracy, in order to simplify equation ((22)), for the present, unknown gas mass $m_{im}$ to be replaced with the old gas mass $$m_{im,n-1} = \frac{V_{im}}{R} \cdot \frac{p_{im,n-1}}{T_{im,n-1}}$$

determined in the preceding calculation step:

$$T_{im} = G_{0,1} + \frac{t_s \cdot R \cdot T_{im,n-1}}{2 \cdot V_{im} \cdot P_{im,n-1}} \cdot \sum_{i=1}^{q+r} (\dot{m}_{in,i}(p_{im}) \cdot (T_{0,i} - T_{im})). \quad ((25))$$

The terms with values known at the start of the calculations for point in time n are combined in order to simplify the further derivation:

$$E = \frac{t_s \cdot R \cdot T_{im,n-1}}{2 \cdot V_{im} \cdot p_{im,n-1}}. \quad ((26))$$

The q inflows influenced by the intake pipe pressure and the r inflows not influenced by the intake pipe pressure are written separately:

$$\begin{aligned} T_{im} &= G_{0,1} + E \cdot \sum_{i=1}^{q} (\dot{m}_{in,i}(p_{im}) \cdot (T_{0,i} - T_{im})) + \\ &\quad E \cdot \sum_{k=1}^{r} (\dot{m}_{in,k} \cdot (T_{0,k} - T_{im})) \\ &= G_{0,1} + E \cdot \sum_{i=1}^{q} (\dot{m}_{in,i}(p_{im}) \cdot (T_{0,i} - T_{im})) + \\ &\quad E \cdot \sum_{k=1}^{r} (\dot{m}_{in,k} \cdot T_{0,k}) - E \cdot T_{im} \cdot \sum_{k=1}^{r} (\dot{m}_{in,k}). \end{aligned} \quad ((27))$$

The terms with values known at the start of the calculations for point in time n are combined in order to simplify the further derivation:

$$G_{0,2} = E \cdot \sum_{k=1}^{r} (\dot{m}_{in,k} \cdot T_{0,k}) \text{ and} \quad ((28))$$

$$G_{1,1} = -E \cdot \sum_{k=1}^{r} (\dot{m}_{in,k}). \quad ((29))$$

The replacement of the inflows influenced by the intake pipe pressure as per equation ((2)) in ((27)) yields $$\begin{aligned} T_{im} &= G_{0,1} + \\ &\quad E \cdot \sum_{i=1}^{q} (A_{in,i} \cdot p_{0,i} \cdot C(T_{0,i}) \cdot \Psi(\Pi_i) \cdot (T_{0,i} - T_{im})) + G_{0,2} + G_{1,1} \cdot T_{im}. \end{aligned} \quad ((30))$$

The replacement of the throughflow coefficients at the i-th throttle point as per equations ((4)) and ((6)) in ((30)) yields $$\begin{aligned} T_{im} &= G_{0,1} + G_{0,2} + G_{1,1} \cdot T_{im} + \\ &\quad E \cdot \sum_{i=1}^{q} \left( A_{in,i} \cdot p_{0,i} \cdot C(T_{0,i}) \cdot \left( \Psi_{offset}(\Pi_i) - \Psi_{slope}(\Pi_i) \cdot \frac{p_{im}}{p_{0,i}} \right) \cdot (T_{0,i} - T_{im}) \right), \end{aligned} \quad ((31))$$

$$\begin{aligned} T_{im} &= G_{0,1} + G_{0,2} + G_{1,1} \cdot T_{im} + \\ &\quad E \cdot \sum_{i=1}^{q} (A_{in,i} \cdot p_{0,i} \cdot C(T_{0,i}) \cdot \Psi_{offset}(\Pi_i) \cdot (T_{0,i} - T_{im})) - \\ &\quad p_{im} \cdot E \cdot \sum_{i=1}^{q} (A_{in,i} \cdot C(T_{0,i}) \cdot \Psi_{slope}(\Pi_i) \cdot (T_{0,i} - T_{im})) \text{ and} \end{aligned} \quad ((32))$$

$$\begin{aligned} T_{im} &= G_{0,1} + G_{0,2} + G_{1,1} \cdot T_{im} + \\ &\quad E \cdot \sum_{i=1}^{q} (A_{in,i} \cdot p_{0,i} \cdot C(T_{0,i}) \cdot \Psi_{offset}(\Pi_i) \cdot T_{0,i}) - \\ &\quad T_{im} \cdot E \cdot \sum_{i=1}^{q} (A_{in,i} \cdot p_{0,i} \cdot C(T_{0,i}) \cdot \Psi_{offset}(\Pi_i)) - \\ &\quad p_{im} \cdot E \cdot \sum_{i=1}^{q} (A_{in,i} \cdot C(T_{0,i}) \cdot \Psi_{slope}(\Pi_i) \cdot T_{0,i}) + \\ &\quad p_{im} \cdot T_{im} \cdot E \cdot \sum_{i=1}^{q} (A_{in,i} \cdot C(T_{0,i}) \cdot \Psi_{slope}(\Pi_i)). \end{aligned} \quad ((33))$$

The terms with values known at the start of the calculations for point in time n are combined in order to simplify the further derivation:

$$G_{0,3} = E \cdot \sum_{i=1}^{q} (A_{in,i} \cdot p_{0,i} \cdot C(T_{0,i}) \cdot \Psi_{offset}(\Pi_i) \cdot T_{0,i}), \quad ((34))$$

$$G_{1,2} = E \cdot \sum_{i=1}^{q} (A_{in,i} \cdot p_{0,i} \cdot C(T_{0,i}) \cdot \Psi_{offset}(\Pi_i)), \quad ((35))$$

$$G_{2,1} = -E \cdot \sum_{i=1}^{q} (A_{in,i} \cdot C(T_{0,i}) \cdot \Psi_{slope}(\Pi_i) \cdot T_{0,i}) \text{ and} \quad ((36))$$

$$G_{3,1} = E \cdot \sum_{i=1}^{q} (A_{in,i} \cdot C(T_{0,i}) \cdot \Psi_{slope}(\Pi_i)). \quad ((37))$$

Equation ((33)) thus simplifies to $$T_{im} = (G_{0,1} + G_{0,2} + G_{0,3}) + (G_{1,1} + G_{1,2}) \cdot T_{im} + G_{2,1} p_{im} + G_{3,1} p_{im} \cdot T_{im} \quad ((38))$$

and further to $$0 = \frac{G_{0,1} + G_{0,2} + G_{0,3}}{G_{3,1}} + \frac{G_{1,1} + G_{1,2} - 1}{G_{3,1}} \cdot T_{im} + \frac{G_{2,1}}{G_{3,1}} \cdot p_{im} + p_{im} \cdot T_{im}. \quad ((39))$$

Analogously to the elimination of the intake pipe pressure gradient in equation ((19)) et seq., the intake pipe temperature gradient is eliminated from the equation system ((16)), ((18)) in a second parallel transformation. Multiplying equation ((16)) by the specific gas constant R yields $$\dot{p}_{im} \cdot V_{im} = c_p \cdot \left( \sum_{i=1}^{q+r} (\dot{m}_{in,i}(p_{im}) \cdot T_{0,i}) - \dot{m}_{out}(p_{im}) \cdot T_{im} \right) - c_v \cdot \left( \dot{m}_{im}(p_{im}) \cdot T_{im} + m_{im}(p_{im}, T_{im}) \cdot \dot{T}_{im} \right). \quad ((40))$$

Multiplying equation ((18)) by the specific heat capacity $c_v$ yields $$c_v \cdot \dot{p}_{im} \cdot V_{im} = c_v \cdot \dot{m}_{im}(p_{im}) \cdot R \cdot T_{im} + c_v \cdot m_{im}(p_{im}, T_{im}) \cdot R \cdot \dot{T}_{im} \quad ((41)).$$

The sum of the equations ((40)) and ((41)) yields $$(c_v + R) \cdot \dot{p}_{im} \cdot V_{im} = R \cdot c_p \cdot \left( \sum_{i=1}^{q+r} (\dot{m}_{in,i}(p_{im}) \cdot T_{0,i}) - \dot{m}_{out}(p_{im}) \cdot T_{im} \right) \quad ((42))$$

and, taking into consideration the definition of the specific gas constant $R = c_p - c_v$, $$\dot{p}_{im} = \frac{R}{V_{im}} \cdot \left( \sum_{i=1}^{q+r} (\dot{m}_{in,i}(p_{im}) \cdot T_{0,i}) - \dot{m}_{out}(p_{im}) \cdot T_{im} \right). \quad ((43))$$

The generally applicable trapezoidal integration formula ((20)) is applied to the intake pipe pressure $p_{im}$ with the sampling time $t_s = t_n - t_{n-1}$:

$$p_{im} = p_{im,n} = p_{im,n-1} + \frac{t_s}{2} \cdot (\dot{p}_{im,n-1} + \dot{p}_{im}). \quad ((44))$$

Old intake pipe pressure $p_{im,n-1}$ and old intake pipe pressure gradient $\dot{p}_{im,n-1}$ are values that are known at the point in time n from the preceding calculation step n−1. By inserting equation ((43)) into ((44)), the intake pipe pressure gradient $\dot{p}_{im}$ is also eliminated:

$$p_{im} = p_{im,n-1} + \frac{t_s}{2} \cdot \dot{p}_{im,n-1} + \frac{t_s}{2} \cdot \frac{R}{V_{im}} \cdot \left( \sum_{i=1}^{q+r} (\dot{m}_{in,i}(p_{im}) \cdot T_{0,i}) - \dot{m}_{out}(p_{im}) \cdot T_{im} \right). \quad ((45))$$

The terms with values known at the start of the calculations for point in time n are combined in order to simplify the further derivation:

$$F_{0,1} = p_{im,n-1} + \frac{t_s}{2} \cdot \dot{p}_{im,n-1} \text{ and} \quad ((46))$$

$$D = \frac{t_s \cdot R}{2 \cdot V_{im}}. \quad ((47))$$

The q inflows influenced by the intake pipe pressure and the r inflows not influenced by the intake pipe pressure are written separately $$p_{im} = F_{0,1} + D \cdot \sum_{i=1}^{q} (\dot{m}_{in,i}(p_{im}) \cdot T_{0,i}) + D \cdot \sum_{k=1}^{r} (\dot{m}_{in,k} \cdot T_{0,k}) - D \cdot \dot{m}_{out}(p_{im}) \cdot T_{in}. \quad ((48))$$

The replacement of the outflow mass flow as per equation ((7)) and of the inflow mass flows as per equation ((2)) yields $$p_{im} = F_{0,1} + D \cdot \sum_{i=1}^{q} (A_{in,i} \cdot p_{0,i} \cdot C(T_{0,i}) \cdot \Psi(\Pi_i) \cdot T_{0,i}) + D \cdot \sum_{k=1}^{r} (\dot{m}_{in,k} \cdot T_{0,k}) - D \cdot \dot{m}_{out}(p_{im}) \cdot T_{im}. \quad ((49))$$

The replacement of the throughflow coefficient at the i-th throttle point as per equations ((4)) and ((6)) in ((49)) yields $$p_{im} = F_{0,1} + D \cdot \sum_{i=1}^{q} \left( A_{in,i} \cdot p_{0,i} \cdot C(T_{0,i}) \cdot \left( \Psi_{offset}(\Pi_i) - \Psi_{slope}(\Pi_i) \cdot \frac{p_{im}}{p_{0,i}} \right) \cdot T_{0,i} \right) + D \cdot \sum_{k=1}^{r} (\dot{m}_{in,k} \cdot T_{0,k}) - D \cdot (\eta_{slope} \cdot p_{im} - \eta_{offset}) \cdot T_{im} \text{ and} \quad ((50))$$

$$p_{im} = F_{0,1} + D \cdot \sum_{i=1}^{q} (A_{in,i} \cdot p_{0,i} \cdot C(T_{0,i}) \cdot \Psi_{offset}(\Pi_i) \cdot T_{0,i}) - D \cdot p_{im} \cdot \sum_{i=1}^{q} (A_{in,i} \cdot C(T_{0,i}) \cdot \Psi_{slope}(\Pi_i) \cdot T_{0,i}) + D \cdot \sum_{k=1}^{r} (\dot{m}_{in,k} \cdot T_{0,k}) + D \cdot \eta_{offset} \cdot T_{im} - D \cdot \eta_{slope} \cdot p_{im} \cdot T_{im}. \quad ((51))$$

The terms with values known at the start of the calculations for point in time n are combined in order to simplify the further derivation:

$$F_{0,2} = D \cdot \sum_{k=1}^{r} (\dot{m}_{in,k} \cdot T_{0,k}), \quad ((52))$$

$$F_{0,3} = D \cdot \sum_{i=1}^{q} (A_{in,i} \cdot p_{0,i} \cdot C(T_{0,i}) \cdot \Psi_{offset}(\Pi_i) \cdot T_{0,i}), \quad ((53))$$

$$F_{1,1} = D \cdot \eta_{offset}, \quad ((54))$$

$$F_{2,1} = -D \cdot \sum_{i=1}^{q} (A_{in,i} \cdot C(T_{0,i}) \cdot \Psi_{slope}(\Pi_i) \cdot T_{0,i}) \text{ and} \quad ((55))$$

$$F_{3,1} = -D \cdot \eta_{slope}. \quad ((56))$$

Equation ((51)) thus simplifies to $$p_{im} = (F_{0,1} + F_{0,2} + F_{0,3}) + F_{1,1} \cdot T_{im} + F_{2,1} \cdot p_{im} + F_{3,1} \cdot p_{im} \cdot T_{im} \quad ((57))$$

and further to $$0 = \frac{F_{0,1} + F_{0,2} + F_{0,3}}{F_{3,1}} + \frac{F_{1,1}}{F_{3,1}} \cdot T_{im} + \frac{F_{2,1} - 1}{F_{3,1}} \cdot p_{im} + p_{im} \cdot T_{im}. \quad ((58))$$

Solution of the Equation System

Equations ((39)) and ((58)) form an equation system of the variables intake pipe pressure $p_{im}$ and intake pipe temperature $T_{im}$ in the form $$p_{im} \cdot T_{im} + a \cdot p_{im} + b \cdot T_{im} + c = 0 \text{ and} \quad ((59))$$

$$p_{im} \cdot T_{im} + d \cdot p_{im} + e \cdot T_{im} + f = 0, \quad ((60))$$

where $$a = \frac{G_{2,1}}{G_{3,1}},\ b = \frac{G_{1,1} + G_{1,2} - 1}{G_{3,1}},$$

$$c = \frac{G_{0,1} + G_{0,2} + G_{0,3}}{G_{3,1}},\ d = \frac{F_{2,1} - 1}{F_{3,1}},$$

$$e = \frac{F_{1,1}}{F_{3,1}},\ f = \frac{F_{0,1} + F_{0,2} + F_{0,3}}{F_{3,1}}.$$

The difference of equations ((59)) and ((60)) yields the linearized intake pipe model at the present operating point $$(a-d)\cdot p_{im}+(b-e)\cdot T_{im}+c-f=0 \quad ((61)).$$

For b=e, according to equation ((61)), any intake pipe temperature changes would not yield a change in the intake pipe pressure, which contradicts the general gas equation ((1)). Thus, the case b=e is physically not relevant. For b≠e, equation ((61)) can be rearranged to $$T_{im} = \frac{d-a}{b-e} \cdot p_{im} + \frac{f-c}{b-e}. \quad ((62))$$

Inserting equation ((62)) into either equation ((59)) or ((60)) yields in each case $$(d-a)\cdot p_{im}^2+(f-c-a\cdot e+b\cdot d)\cdot p_{im}+(b\cdot f-c\cdot e)=0 \quad ((63)).$$

For a=d, according to equation ((61)), any intake pipe pressure changes would not yield a change in the intake pipe temperature, which contradicts the general gas equation ((1)). Thus, the case a=d is also physically not relevant. For a≠d, equation ((63)) can be rearranged to $$p_{im}^2 + \frac{f-c-a\cdot e+b\cdot d}{d-a} \cdot p_{im} + \frac{b\cdot f-c\cdot e}{d-a} = x^2 + P\cdot x + Q = 0. \quad ((64))$$

The solution formula of the quadratic equation $$p_{im} = -\frac{P}{2} \pm \sqrt{\frac{P^2}{4} - Q} = -\frac{f-c-a\cdot e+b\cdot d}{2\cdot(d-a)} \pm \sqrt{\frac{(f-c-a\cdot e+b\cdot d)^2}{4\cdot(d-a)^2} - \frac{b\cdot f-c\cdot e}{d-a}} \quad ((65))$$

always yields two solutions for the practically relevant cases for the point in time n. As an approximation of the intake pipe pressure for the point in time n, owing to the actually present continuity of the intake pipe pressure, use is made in each case of that solution which lies closer to the old solution for the point in time n−1.

In summary, the intake pipe pressure $p_{im}$ and intake pipe temperature $T_{im}$ for the point in time n are modelled, from the equations ((60)), ((62)) and ((65)), as $$p_{im,mdl} = -\frac{f-c-a\cdot e+b\cdot d}{2\cdot(d-a)} \pm \sqrt{\frac{(f-c-a\cdot e+b\cdot d)^2}{4\cdot(d-a)^2} - \frac{b\cdot f-c\cdot e}{d-a}} \text{ and} \quad ((66))$$

$$T_{im,mdl} = \frac{d-a}{b-e} \cdot p_{im} + \frac{f-c}{b-e} \quad ((67))$$

where $$a = \frac{G_{2,1}}{G_{3,1}},\ b = \frac{G_{1,1} + G_{1,2} - 1}{G_{3,1}},$$

$$c = \frac{G_{0,1} + G_{0,2} + G_{0,3}}{G_{3,1}},\ d = \frac{F_{2,1} - 1}{F_{3,1}},$$

$$e = \frac{F_{1,1}}{F_{3,1}},\ f = \frac{F_{0,1} + F_{0,2} + F_{0,3}}{F_{3,1}},$$

$$D = \frac{t_s \cdot R}{2 \cdot V_{im}},\ E = \frac{t_s \cdot R \cdot T_{im,mdl,n-1}}{2 \cdot V_{im} \cdot p_{im,mdl,n-1}},$$

$$F_{0,1} = p_{im,mdl,n-1} + \frac{t_s}{2} \cdot \dot{p}_{im,mdl,n-1},$$

$$F_{0,2} = D \cdot \sum_{k=1}^{r} (\dot{m}_{in,k} \cdot T_{0,k}),$$

$$F_{0,3} = D \cdot \sum_{i=1}^{q} (A_{in,i} \cdot p_{0,i} \cdot C(T_{0,i}) \cdot \Psi_{offset}(\Pi_i) \cdot T_{0,i}),$$

$$F_{1,1} = D \cdot \eta_{offset},$$

$$F_{2,1} = -D \cdot \sum_{i=1}^{q} (A_{in,i} \cdot C(T_{0,i}) \cdot \Psi_{slope}(\Pi_i) \cdot T_{0,i}),$$

$$F_{3,1} = -D \cdot \eta_{slope},$$

$$G_{0,1} = T_{im,mdl,n-1} + \frac{t_s}{2} \cdot \dot{T}_{im,mdl,n-1},$$

$$G_{0,2} = E \cdot \sum_{k=1}^{r} (\dot{m}_{in,k} \cdot T_{0,k}),$$

$$G_{0,3} = E \cdot \sum_{i=1}^{q} (A_{in,i} \cdot p_{0,i} \cdot C(T_{0,i}) \cdot \Psi_{offset}(\Pi_i) \cdot T_{0,i}),$$

$$G_{1,1} = -E \cdot \sum_{k=1}^{r} (\dot{m}_{in,k}),$$

$$G_{1,2} = -E \cdot \sum_{i=1}^{q} (A_{in,i} \cdot p_{0,i} \cdot C(T_{0,i}) \cdot \Psi_{offset}(\Pi_i)),$$

$$G_{2,1} = -E \cdot \sum_{i=1}^{q} (A_{in,i} \cdot C(T_{0,i}) \cdot \Psi_{slope}(\Pi_i) \cdot T_{0,i}) \text{ and}$$

$$G_{3,1} = E \cdot \sum_{i=1}^{q} (A_{in,i} \cdot C(T_{0,i}) \cdot \Psi_{slope}(\Pi_i)).$$

Alignment of the Intake Pipe Model with the Measured Gas State

In quasi-steady-state operation, that is to say after all input signals into the intake pipe model have been substantially constant for several seconds, it is advantageous if the intake pipe model outputs the intake pipe pressure $p_{im,mdl}=p_{im,mes}$ measurable by way of the sensor and the measurable intake pipe temperature $T_{im,mdl}=T_{im,mes}$. The form of the intake pipe model provided by equations ((66)) and ((67)) cannot ensure this because these are not dependent on the measured intake pipe pressure $p_{im,mes}$ or on the measured intake pipe temperature $T_{im,mes}$. In particular, the disregarding of heat transfer through the intake pipe wall, as assumed in equation ((11)), falsifies the intake pipe model significantly in the steady state. To nevertheless align measurement values and model outputs in the steady state, at least three methods are possible:

1. Observer correction: for example, one or more inputs of the model may be automatically corrected such that the model deviations $T_{im,mes}-T_{im,mdl}$ and/or $p_{im,mes}-p_{im,mdl}$ are minimized. For this purpose, in quasi-steady-state operation, a temperature measurement value of the gas is provided which is representative of a temperature of the gas at the present point in time. Depending on the model temperature for the present point in time and the provided temperature measurement value, a temperature corrective value is determined. The temperature corrective value is assigned to the intake pipe model and, at least in transient operation and quasi-steady-state operation, the model temperature for the present state is determined, in a manner dependent on the temperature corrective value, by way of the intake pipe model.

The temperature corrective value may be determined such that the difference between model temperature and temperature measurement value is minimized. For example, the model variable "temperature of the throttle flap mass flow" of the intake pipe model is corrected by way of the temperature corrective value. It is alternatively or additionally also possible for an additional model input "heat flow through the intake pipe wall" to be introduced, which is not physically modelled and which is corrected by way of the temperature corrective value such that the difference between model temperature and temperature measurement value is minimized.

In some embodiments, in a quasi-steady-state operation, a pressure measurement value of the gas is provided which is representative of a pressure of the gas at the present point in time. Depending on the model pressure for the present point in time and the provided pressure measurement value, a pressure corrective value is determined. The pressure corrective value is assigned to the intake pipe model and, at least in the first and the second operating state, the model pressure for the present state is determined, in a manner dependent on the pressure corrective value, by way of the intake pipe model.

The pressure corrective value is for example determined such that the difference between model pressure and pressure measurement value is minimized. For example, a model variable of the intake pipe model which is representative of the effective cross-sectional area of the throttle flap is corrected by way of the pressure corrective value such that the difference between model pressure and pressure measurement value is minimized.

2. Incremental model correction: the model temperature and/or the model pressure for the present point in time may be adapted in a manner dependent on the provided temperature measurement value and/or pressure measurement value by virtue of the model temperature and/or the model pressure being corrected in the direction of the temperature measurement value and/or of the pressure measurement value by a predefined factor. For this purpose, it is the case in particular that the model outputs $T_{im,mdl}$ and $p_{im,mdl}$ from equations ((66)), ((67)) are, in each sampling step, shifted in the direction of measurement values by predefined increments $T_{im,inc}$ and $p_{im,inc}$ which are to be calibrated:

$$p_{im,mdl,cor1}=p_{im,mdl}+sgn(p_{im,mes}-p_{im,mdl})\cdot T_{inc} \quad ((68))$$

$$T_{im,mdl,cor1}=T_{im,mdl}+sgn(T_{im,mes}-T_{im,mdl})\cdot T_{inc} \quad ((69)).$$

And the parameters of the intake pipe model ((66)), ((67)) must be correspondingly corrected:

$$E=\frac{t_s\cdot R\cdot T_{im,mdl,cor1,n-1}}{2\cdot V_{im}\cdot p_{im,mdl,cor1,n-1}},\quad ((70))$$

$$F_{0,1}=p_{im,mdl,cor1,n-1}+\frac{t_s}{2}\cdot \dot{p}_{im,mdl,cor1,n-1} \text{ and}$$

$$G_{0,1}=T_{im,mdl,cor1,n-1}+\frac{t_s}{2}\cdot \dot{T}_{im,mdl,cor1,n-1}.$$

3. Proportional model correction: in some embodiments, the model temperature and/or the model pressure for the present point in time may be adapted in a manner dependent on the provided temperature measurement value and/or pressure measurement value by virtue of the model temperature being corrected in the direction of the temperature measurement value in a manner dependent on the magnitude of the difference of the model temperature and on the provided temperature measurement value and/or by virtue of the model pressure being corrected in the direction of the pressure measurement value in a manner dependent on the magnitude of the difference of the model pressure and on the provided pressure measurement value. It is thus the case in particular that the model outputs $T_{im,mdl}$ and $p_{im,mdl}$ from equations ((66)), ((67)) are, in each sampling step, shifted in the direction of measurement values by fractions, which are to be calibrated, of the model errors $FT_{im,inc}$ and $Fp_{im,inc}$:

$$p_{im,mdl,cor2}=p_{im,mdl}+(p_{im,mes}-p_{im,mdl})\cdot F_{p_{inc}} \quad ((71)) \text{ and}$$

$$T_{im,mdl,cor2}=T_{im,mdl}+(T_{im,mes}-T_{im,mdl})\cdot F_{T_{inc}} \quad ((72)).$$

The parameters of the intake pipe model ((66)), ((67)) must be correspondingly corrected:

$$E=\frac{t_s\cdot R\cdot T_{im,mdl,cor2,n-1}}{2\cdot V_{im}\cdot p_{im,mdl,cor2,n-1}}\quad ((73))$$

$$F_{0,1}=p_{im,mdl,cor2,n-1}+\frac{t_s}{2}\cdot \dot{p}_{im,mdl,cor2,n-1}$$

$$G_{0,1}=T_{im,mdl,cor2,n-1}+\frac{t_s}{2}\cdot \dot{T}_{im,mdl,cor2,n-1},$$

With these methods, it is possible, in series-production engine control units, for the influence of fast changes in the temperature of the gas in the intake tract 1 on the cylinder air mass to be described more accurately than is possible on the basis of a measurement using temperature sensors available for series-production engines. By way of the more accurate fuel metering and the more accurate determination of the cylinder air mass, it is possible for pollutant emissions of the internal combustion engine to be reduced.

The control device 25 is designed to carry out the above-described process and thus in particular determine the cylinder air mass that is situated in the respective cylinder after closure of the gas exchange valves.

What is claimed is:

1. A method for operating an internal combustion engine comprising an intake tract and one or more cylinders with associated gas exchange valves comprising gas inlet valves and gas outlet valves, the method comprising:

calculating a model temperature of a gas in the intake tract cyclically for a present point in time using a predefined intake pipe model without reference to a present temperature measurement value of the gas, while input signals to the model are varying;

wherein the model for the present point in time depends at least in part on a model temperature determined for a preceding point in time;

determining a cylinder air mass situated in a respective cylinder after closing the gas exchange valves based at least in part on the model temperature determined for the present point in time;

after all input signals to the model are stable for a predetermined time period greater than one second, receiving a temperature measurement value representative of a temperature of the gas at the present point in time;

determining a temperature corrective value based at least in part on the model temperature for the present point in time and the provided temperature measurement value;

assigning the temperature corrective value to the intake pipe model; and determining the cylinder air mass depending on the temperature corrective value going forward; and metering fuel into the respective cylinder based at least in part on the determined cylinder air mass.

2. The method as claimed in claim 1, further comprising adapting the model temperature for the present point in time based at least in part on the provided temperature measurement value by correcting the model temperature in the direction of the temperature measurement value by a predefined factor.

3. The method as claimed in claim 1, further comprising adapting the model temperature for the present point in time based at least in part on the provided temperature measurement value by correcting the model temperature in the direction of the temperature measurement value based on the magnitude of the difference of the model temperature and the provided temperature measurement value.

4. The method as claimed in claim 1, further comprising:

determining a model pressure of a gas in the intake tract cyclically for a present point in time based at least in part on the predefined intake pipe model and independently of a pressure measurement value of the gas assigned to the present point in time;

wherein the model pressure for the present point in time depends at least in part on a model pressure that has been determined for a preceding point in time; and determining the cylinder air mass based at least in part on the model pressure determined for the present point in time.

5. The method as claimed in claim 4, further comprising:

in the second operating state, receiving a pressure measurement value of the gas representative of a pressure of the gas at the present point in time;

determining a pressure corrective value based at least in part on the model pressure for the present point in time and the pressure measurement value;

assigning the pressure corrective value to the intake pipe model; and determining the model pressure for the present state based at least in part on the pressure corrective value, using the intake pipe model.

6. The method as claimed in claim 4, further comprising:

in the second operating state, receiving the pressure measurement value of the gas representative of a pressure of the gas at the present point in time; and adapting the model pressure for the present point in time based at least in part on the pressure measurement value.

7. The method as claimed in claim 6, further comprising adapting the model pressure for the present point in time based at least in part on the provided pressure measurement value by correcting the model pressure in the direction of the pressure measurement value by a predefined factor.

8. The method as claimed in claim 6, further comprising adapting the model pressure for the present point in time based at least in part on the provided pressure measurement value by correcting the model pressure in the direction of the pressure measurement value based on the magnitude of the difference of the model pressure and the provided pressure measurement value.

* * * * *